US005752460A

United States Patent [19]

Buffman et al.

[11] Patent Number: 5,752,460

[45] Date of Patent: May 19, 1998

[54] SUBMERGIBLE TOWED BODY SYSTEM

[75] Inventors: Martin Buffman, Little Compton; John R. Short, Portsmouth; James G. Kelly, Newport, all of R.I.

[73] Assignee: The United States of America as represented by the Secretary of the Navy, Washington, D.C.

[21] Appl. No.: 605,235

[22] Filed: Feb. 2, 1996

[51] Int. Cl.[6] ..... B63B 21/66

[52] U.S. Cl. ..... 114/244; 114/312

[58] Field of Search ..... 114/242, 244, 114/245, 253, 312, 313, 322, 330, 331, 357, 123; 441/74; 367/13, 16, 910

[56] References Cited

U.S. PATENT DOCUMENTS

| | | | |
|---|---|---|---|
| 3,034,468 | 5/1962 | Aschinger | 114/244 |
| 4,010,619 | 3/1977 | Hightower et al. | 405/191 |
| 4,713,032 | 12/1987 | Frank | 441/74 |
| 5,231,610 | 7/1993 | Barksdale, Jr. et al. | 367/99 |
| 5,282,436 | 2/1994 | Hansen | 114/357 |
| 5,370,074 | 12/1994 | Knudsen et al. | 114/312 |

*Primary Examiner*—Ed L. Swinehart

*Attorney, Agent, or Firm*—Michael J. McGowan; James M. Kasischke; Prithvi C. Lall

[57] ABSTRACT

A submergible towed body system carries an acoustic transmission/reception device under the surface of the water and relays signals between the acoustic transmission/reception device and a surface platform. An elongated support frame has upper and lower horizontal frame sections maintained in a parallel spaced apart relationship by a plurality of vertical frame supports. A float is attached on top of the upper horizontal frame section and a tow point depends from the upper horizontal frame section. Attached to the upper and lower horizontal frame sections is a combination tilt and pan mechanism that allows the acoustic transmission/reception device to pan through a prescribed horizontal angle and tilt through a prescribed vertical angle. Circuitry is mounted between the upper and lower horizontal frame sections and aft of the tilt and pan mechanism for electrically connecting the surface platform to the acoustic transmission/reception device.

14 Claims, 2 Drawing Sheets

SUBMERGIBLE TOWED BODY SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION

1. Field of the Invention

The present invention relates generally to submergible and towable platforms, and more particularly to a submergible towed body system for carrying an acoustic transmission/reception device (e.g., the nose section of a torpedo) under the surface of the water.

2. Description of the Prior Art

Testing a torpedo's capability in terms of transmitting acoustic beams and receiving acoustic signals has traditionally been accomplished during testing of the actual torpedo. Unfortunately, actual torpedo testing is expensive and requires specialized launching equipment or the actual launching vessel. Further, this type of testing is only capable of providing system level information. As a result, advanced processing techniques, i.e., based on the torpedo's individual sensor elements, are not used. However, such advanced processing techniques are useful in providing shallow water waveforms that enhance the torpedo's detection/classification capabilities. Thus, a need exists for a simple, low cost system for testing the acoustic transmission/reception capability of a torpedo.

SUMMARY OF THE INVENTION

Accordingly, it is an object of the present invention to provide a submergible platform useful in testing the acoustic transmission/reception portion of a torpedo.

Another object of the present invention is to provide a submergible platform that can be moved to simulate a torpedo's behavior in terms of transmitting acoustic beams and receiving acoustic signals at both the system and advanced signal processing levels.

Yet another object of the present invention is to provide a portable and submergible platform for carrying the acoustic transmission/reception portion of a torpedo.

Still another object of the present invention is to provide a submergible platform for carrying the acoustic transmission/reception portion of a torpedo and for carrying a variety of environmental data gathering instrumentation.

Other objects and advantages of the present invention will become more obvious hereinafter in the specification and drawings.

In accordance with the present invention, a submergible towed body system carries an acoustic transmission/reception device under the surface of the water and relays signals between the acoustic transmission/reception device and a surface platform. An elongated support frame has upper and lower horizontal frame sections maintained in a parallel spaced apart relationship by a plurality of vertical frame supports. A float is attached on top of the upper horizontal frame section. A tow point depends from the upper horizontal frame section for receiving a tow line. Attached to the upper and lower horizontal frame sections is a combination tilt and pan mechanism. The tilt and pan mechanism suspends the acoustic transmission/reception device between the upper and lower horizontal frame sections at a forward region of the elongated support frame. The tilt and pan mechanism allows the acoustic transmission/reception device to pan through a prescribed horizontal angle and tilt through a prescribed vertical angle. Circuitry is mounted between the upper and lower horizontal frame sections and aft of the tilt and pan mechanism for electrically connecting the surface platform to individual acoustic transponder elements mounted in the acoustic transmission/reception device and any other instruments maintained on the towed body.

BRIEF DESCRIPTION OF THE DRAWING(S)

Other objects, features and advantages of the present invention will become apparent upon reference to the following description of the preferred embodiments and to the drawings, wherein:

FIG. 1 is a side view, partially cut away, of the submergible towed body system of the present invention as it is being towed by a tow vessel; and FIG. 2 is a head-on view of the present invention as viewed from line 2—2 in FIG. 1.

DESCRIPTION OF THE PREFERRED EMBODIMENT(S)

Figure 1:
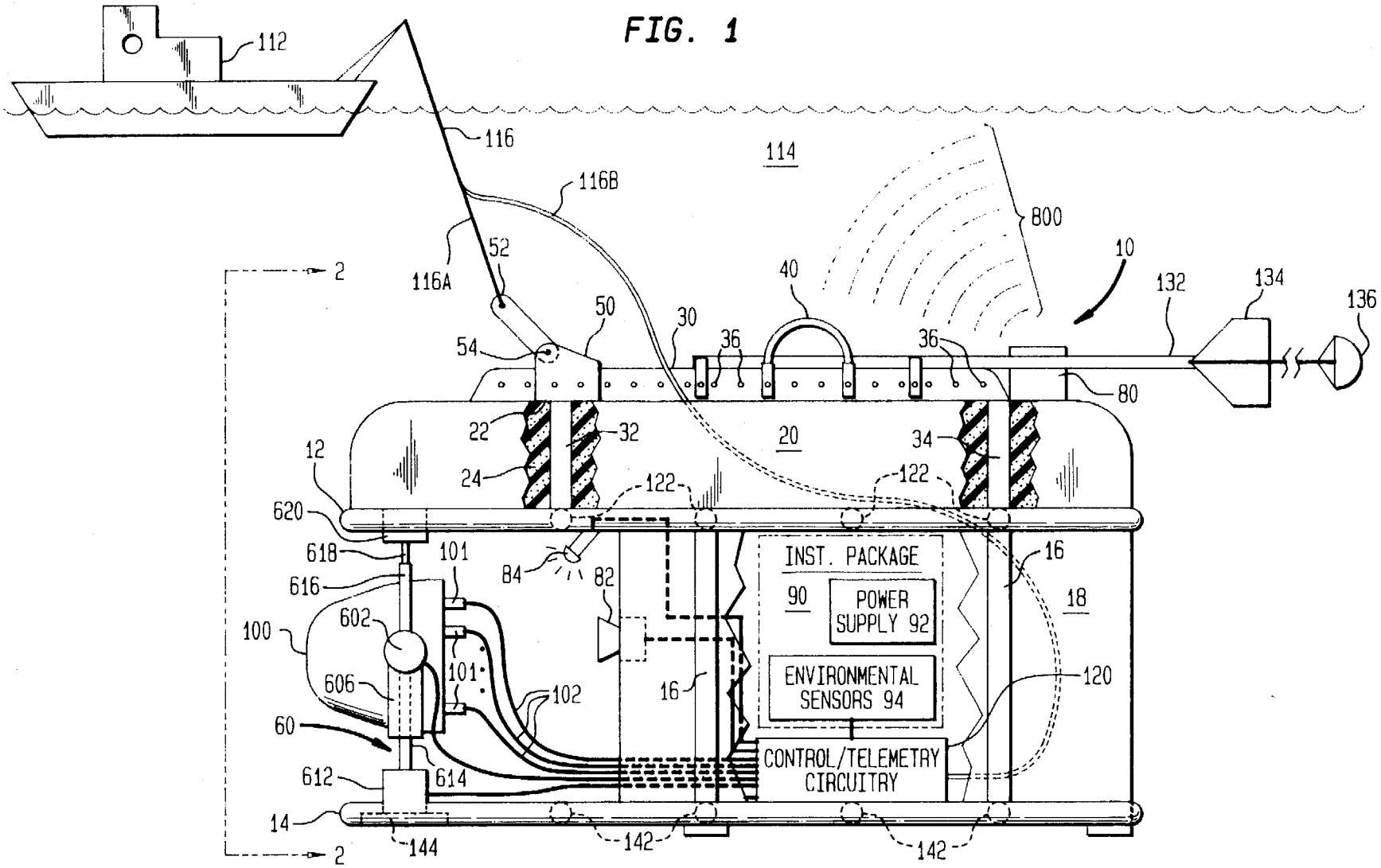
Figure 2:
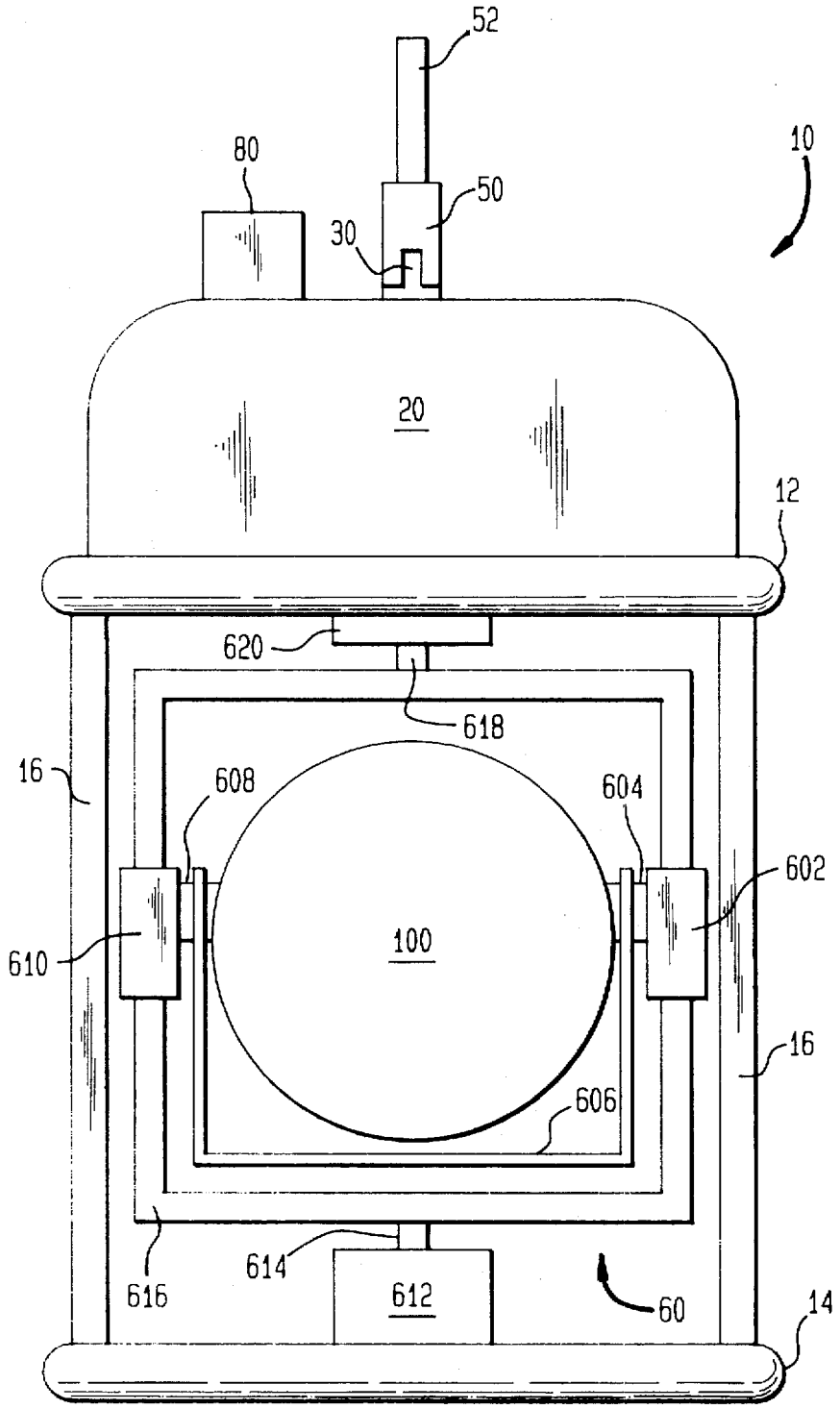

Referring now to FIGS. 1 and 2, like reference numerals will be used throughout for those elements that are common between the two views. A submergible towed body system is shown and referenced generally by the numeral 10. Tow vessel 112 tows system 10 through water 114 by tow cable 116. Tow cable 116 has strength bearing members and communications members therein. Test object or device 100 is mounted on system 10 for hydrodynamic and acoustic testing. Affixed via ROD 132 at the aft end of system 10 is vane 134 for holding system 10 on a fixed course. Positioned aft of vane 134 is drogue 136 which acts to stabilize system 10 in terms of attitude. Stabilization of system 10 is necessary because tow cable 116 joins the body of system 10 near the upper surface thereof in order to minimize noise at the forward portion of system 10.

Structurally, system 10 maximizes stability of a sonar sensing system, e.g., device 100, that is to be towed through the water at speeds ranging between 1–10 knots. To achieve such stability, system 10 includes upper and lower horizontal frame sections 12 and 14 maintained in a spaced apart relationship by vertical supports 16. Each of frame sections 12 and 14 is a tubular frame construction that includes respective elongated perimeter tubes 120 and 140, and a plurality of respective cross-member tubes 122 and 142 for rigidity. Frame sections 12 and 14, and vertical supports 16, are typically chosen to be a strong, non-corrosive material such as aluminum, fiberglass, or the like. Attachment of cross-member tubes 122 and 142, and vertical supports 16, can be by conventional methods, e.g., welding, brazing, brackets and bolts, etc. A smooth surface polyurethane shell 18 encloses a volume between frame sections 12 and 14 that extends over approximately the aft two-thirds portion of system 10. Shell 18 forms a water-tight hydrodynamic outer shell. Ballast (not shown) can be positioned inside shell 18 to provide the correct buoyancy for system 10.

Mounted on top of upper horizontal frame section 12 is float assembly 20 which includes, as shown in the cut away portion of FIG. 1, polyurethane coating 22 attached to frame section 12 by conventional means (not shown) on top of buoyant material 24 which is, for example, a high-density buoyant foam. Polyurethane coating 22 protects buoyant material 24 and provides float assembly 20 with a continuous smooth surface for good hydrodynamic flow characteristics.

Above float assembly 20 is mounting plate 30 running substantially along the length of system 10. Mounting plate 30 is structurally connected to upper horizontal frame section 12 by means of supports 32 and 34 located at the fore and aft ends, respectively, of mounting plate 30. Supports 32 and 34 can be connected to frame section 12 and mounting plate 30 by conventional means. A plurality of mounting holes 36 are provided in mounting plate 30 to allow for the adjustable-position mounting of center-of-gravity lift handle 40 and towing bracket 50. Handle 40 provides a stable lift point for system 10. Towing bracket 50 supports tow bar 52 hinged to towing bracket 50 at hinge point 54. Tow bar 52 serves as the attachment point for the strength bearing member portion 116A of tow cable 116.

At the fore end of system 10 is tilt and pan mechanism 60 for holding and moving an acoustic transmission/reception device 100 that is to be tested. By way of example, device 100 can be one of the U.S. Navy's MK-48 ADCAP or MK50 torpedo nose sections provided with a plurality of electrical taps 101 that electrically connect individual sensor elements (not shown) mounted in and on device 100 with signal lines 102. Signal lines 102 transmit signals to and from control/telemetry circuitry 120 maintained in shell 18.

Tilt and pan mechanism 60 has a tilt assembly that includes tilt motor 602, drive shaft 604, cradle 606, rotatable shaft 608 and bearing 610. In addition, tilt and pan mechanism 60 has a pan assembly that includes pan motor 612 mounted on horizontal support plate 144 spanning the forward portion of frame section 14, drive shaft 614, cradle 616, rotatable shaft 618 and bearing 620. Motors 602 and 612 are typically conventional servo motors. When tilt motor 602 is activated, drive shaft 604 rotates causing device 100 to pass through a prescribed vertical angle. When pan motor 612 is activated, drive shaft 614 rotates causing device 100 to pass through a prescribed horizontal angle.

A variety of electronic systems can be a part of system 10. For example, acoustic transponder 80 is provided at the aft end of float assembly 20 for outputting acoustic signal 800 used to track the position of system 10 when it is submerged. Note that it is desirable to locate transponder 80 as far as possible from device 100 so as not to interfere with the testing of device 100. In order to view the environment around device 100, underwater video camera 82 and lighting 84 is provided aft of device 100 as shown. Camera 82 and lighting 84 are controlled by signals received from control/telemetry circuitry 120. Camera 82 returns a video signal to tow vessel 112 via control/telemetry circuitry 120.

Additional electronic systems can be provided within polyurethane shell 18. To provide for additional electronic components, system 10 incorporates one or more pressure-tolerant, water-tight instrument packages within polyurethane shell 18. One such package is shown and referenced by numeral 90. To provide the necessary power for a wide variety of electronic measuring/testing equipment, instrument package 90 includes power supply 92 for supplying, for example, ±5 VDC at 12 amps, ±15 VDC at 12 amps, and ±24 VDC at 5 amps. Instrument package 90 can include instruments such as a heading sensor, a depth gauge, accelerometers, and an inclinometer, which are referenced in FIG. 1 as environmental sensors 94.

In operation, device 100 is installed in tilt and pan mechanism 60 and system 10 is towed in the water. Control signals pass to system 10 and device 100 over tow cable 116. The control signal portion 116B of tow cable 116 is separated from strength bearing member portion 116A near the body of system 10. The control and data signals passed on control signal portion 116B are decoded by control/telemetry circuitry 120 and passed to, for example, motors 602 and/or 612, video camera 82, instrument package 90, device 100, etc. Data collected by video camera 82, instrument package 90, device 100, etc. is assembled in an orderly fashion, e.g., multiplexed by control/telemetry circuitry 120, and passed back to the tow vessel over cable 116.

Although the present invention has been described relative to a specific embodiment, it is not so limited. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A submergible towed body system for carrying an acoustic transmission/reception device under the surface of the water, comprising:

a support frame having upper and lower horizontal frame sections and a plurality of vertical frame supports, said horizontal frame sections being maintained in a parallel spaced apart relationship by said plurality of vertical frame supports connecting said horizontal frame sections;

a float attached to said upper horizontal frame section;

a tow point depending from said upper horizontal frame section;

a tow cable joined to said tow point having data communication members and strength members therein;

means for suspending said acoustic transmission/reception device between said upper and lower horizontal frame sections, said means for suspending including means for panning said acoustic transmission/reception device through a prescribed horizontal angle, said means for suspending further including means for tilting said acoustic transmission/reception device through a prescribed vertical angle; and data communication electronics mounted between said upper and lower horizontal frame sections and joined to said acoustic transmission/reception device and to said tow cable data communication members for multiplexing data collected by said acoustic transmission/reception device and transmitting said multiplexed data.

2. A submergible towed body system as in claim 1 wherein said float comprises a high-density buoyant foam covered with polyurethane.

3. A submergible towed body system as in claim 1 wherein said means for suspending is mounted forward of said data communication electronics.

4. A submergible towed body system as in claim 1 further comprising means attached to said support frame for stabilizing the attitude of said towed body system.

5. A submergible towed body system as in claim 1 further comprising a transponder coupled to said support frame, said transponder being positioned on said frame such that its signal is shielded from said acoustic transmission/reception device by said float, for outputting a signal used to track the position of said towed body system.

6. A submergible towed body system as in claim 1 further comprising a video camera having a field-of-view, said video camera being coupled to said support frame for providing a video signal corresponding to said field-of-view, said field of view including said acoustic transmission/reception device.

7. A submergible towed body system as in claim 1 further comprising a power supply for supplying power to said acoustic transmission/reception device and said electronic means.

8. A submergible towed body system as in claim 4 wherein said means for stabilizing said towed body system comprises:

a tail joined to the aft of said support frame; and a drogue having a tether and a chute, a first end of said tether being joined to the end of said tail and a distal end of said tether being joined to said chute.

9. A submergible towed body system for carrying an acoustic transmission/reception device under the surface of the water and for relaying signals between the acoustic transmission/reception device and a surface platform, comprising:

an elongated support frame having upper and lower horizontal frame sections and a plurality of vertical frame supports, said horizontal frame sections being maintained in a parallel spaced apart relationship by said plurality of vertical frame supports connecting said horizontal frame sections;

a float attached on top of said upper horizontal frame section;

a tow point depending from said upper horizontal frame section;

a tow cable joined to said tow point having data communication members and strength members therein;

a first rotatable frame for supporting the acoustic transmission/reception device, said first rotatable frame including a rotational drive for tilting the acoustic transmission/reception device through a prescribed vertical angle;

a second rotatable frame attached to said upper and lower horizontal frame sections for suspending said first rotatable frame between said upper and lower horizontal frame sections at a forward region of said elongated support frame, said second rotatable frame including a rotational drive for panning said first rotatable frame through a prescribed horizontal angle, wherein the acoustic transmission/reception device is panned through said prescribed horizontal angle; and data communication circuitry mounted between said upper and lower horizontal frame sections and aft of said second rotatable frame and joined to said acoustic transmission/reception device and to said tow cable data communication members for multiplexing control and data signals between the surface platform and the acoustic transmission/reception device.

10. A submergible towed body system as in claim 9 wherein said float comprises a high-density buoyant foam covered with polyurethane to present an essentially smooth continuous surface about said foam.

11. A submergible towed body system as in claim 9 further comprising means attached to said support frame for stabilizing the attitude of said towed body system.

12. A submergible towed body system as in claim 9 further comprising a transponder coupled to said support frame, said transponder being positioned on said frame such that its signal is shielded from said acoustic transmission/reception device by said float, for outputting a signal used to track the position of said towed body system.

13. A submergible towed body system as in claim 9 further comprising a video camera having a field-of-view, said video camera being joined to said data communication circuitry and coupled to said support frame for providing a video signal corresponding to said field-of-view, said field of view including said acoustic transmission/reception device.

14. A submergible towed body system as in claim 9 further comprising a power supply for supplying power to said acoustic transmission/reception device and said electronic means.

* * * * *